US005979726A

United States Patent [19]

Chisholm et al.

[11] Patent Number: 5,979,726

[45] Date of Patent: Nov. 9, 1999

[54] SKI SECUREMENT AND CARRYING HARNESS

[76] Inventors: Leon Chisholm; Fannie Chisholm, both of 2524 Redwood Dr., Dalzell, S.C. 29040

[21] Appl. No.: 09/179,376

[22] Filed: Oct. 26, 1998

[51] Int. Cl.[6] ..... A45C 15/00

[52] U.S. Cl. ..... 224/578; 224/581; 224/586; 224/676; 224/917

[58] Field of Search ..... 224/578, 581, 224/586, 616, 663, 917, 676, 250, 257, 258; 294/147

[56] References Cited

U.S. PATENT DOCUMENTS

| | | | |
|---|---|---|---|
| D. 337,882 | 8/1993 | Bender et al. | D3/259 |
| 4,114,838 | 9/1978 | Knauf | 294/157 |
| 4,852,931 | 8/1989 | Ferdi | 294/147 |
| 4,863,083 | 9/1989 | Chen | 224/663 |
| 5,040,324 | 8/1991 | Rivera et al. | 43/26 |
| 5,160,074 | 11/1992 | Coates | 224/257 |
| 5,350,096 | 9/1994 | Sieber | 224/586 |
| 5,400,937 | 3/1995 | Rottenberg | 224/258 |
| 5,450,991 | 9/1995 | Neading | 224/578 |

*Primary Examiner*—Stephen P. Garbe
*Assistant Examiner*—Maerena W. Brevard

[57] ABSTRACT

A ski securement and carrying harness including an adjustable central strap member. A first securement strap is fixedly secured to an upper end of the central strap member. The first securement strap secures to a pair of skis disposed below toe bindings thereof to facilitate securement of the pair of skis together. A second securement strap is fixedly secured to a lower end of the central strap member. The second securement strap secures to the pair of skis disposed below heel bindings thereof to facilitate securement of the pair of skis together. A third securement strap is slidably coupled with the central strap member by a coupling loop intermediate the first securement strap and the adjustment bracket. The third securement strap secures to the pair of skis disposed between the toe bindings and upper tips thereof.

8 Claims, 3 Drawing Sheets

FIG 5
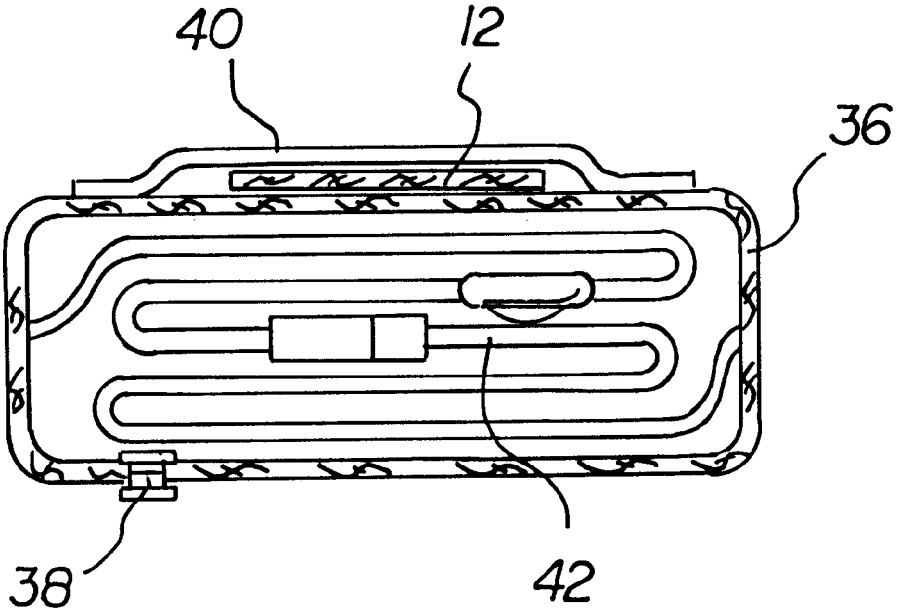
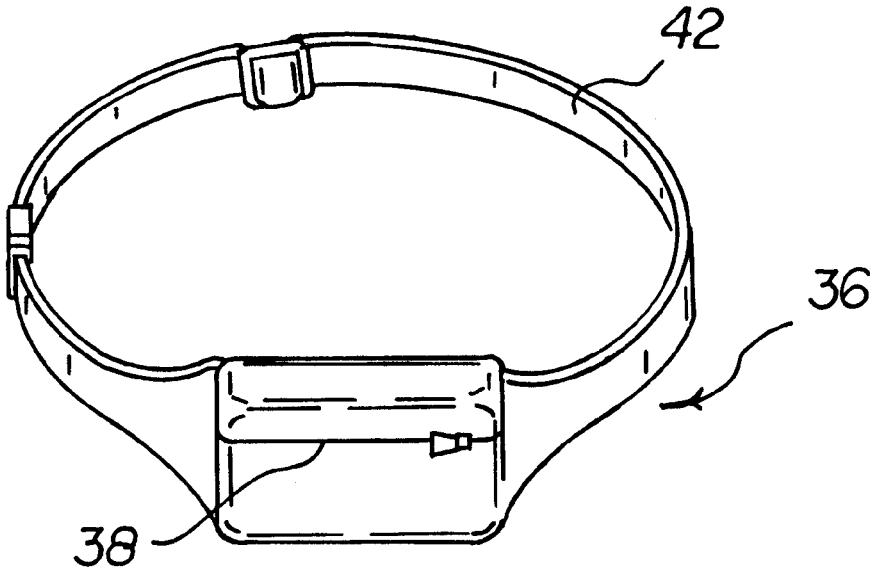
FIG 6

SKI SECUREMENT AND CARRYING HARNESS

BACKGROUND OF THE INVENTION

1. Field of the Invention

The present invention relates to a ski securement and carrying harness and more particularly pertains to enabling a skier to carry their skis in a practical manner with a ski securement and carrying harness.

2. Description of the Prior Art

The use of ski carriers is known in the prior art. More specifically, ski carriers heretofore devised and utilized for the purpose of carrying skis are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,400,937 to Rottenberg; U.S. Pat. No. 4,114,838 to Knauf; U.S. Pat. No. 4,852,931 to Ferdi; U.S. Pat. No. 5,160,074 to Coates; U.S. Pat. No. 5,350,096 to Sieber; and U.S. Pat. No. Des. 337,882 to Bender et al.

While these devices fulfill their respective, particular objective and requirements, the aforementioned patents do not describe a ski securement and carrying harness for enabling a skier to carry their skis in a practical manner.

In this respect, the ski securement and carrying harness according to the present invention substantially departs from the conventional concepts and designs of the prior art, and in doing so provides an apparatus primarily developed for the purpose of enabling a skier to carry their skis in a practical manner.

Therefore, it can be appreciated that there exists a continuing need for new and improved ski securement and carrying harness which can be used for enabling a skier to carry their skis in a practical manner. In this regard, the present invention substantially fulfills this need.

SUMMARY OF THE INVENTION

In the view of the foregoing disadvantages inherent in the known types of ski carriers now present in the prior art, the present invention provides an improved ski securement and carrying harness. As such, the general purpose of the present invention, which will be described subsequently in greater detail, is to provide a new and improved ski securement and carrying harness and method which has all the advantages of the prior art and none of the disadvantages.

To attain this, the present invention essentially comprises an adjustable central strap member having an adjustment bracket disposed thereon to facilitate varying a total length thereof. A first securement strap is fixedly secured to an upper end of the central strap member. The first securement strap has hook and loop closures disposed on opposing free ends thereof for coupling together to form a loop. The first securement strap secures to a pair of skis disposed below toe bindings thereof to facilitate securement of the pair of skis together. A second securement strap is fixedly secured to an O-ring disposed on a lower end of the central strap member. The second securement strap has hook and loop closures disposed on opposing free ends thereof for coupling together to form a loop. The second securement strap secures to the pair of skis disposed below heel bindings thereof to facilitate securement of the pair of skis together. A third securement strap is slidably coupled with the central strap member by a coupling loop intermediate the first securement strap and the adjustment bracket. The third securement strap has hook and loop closures disposed on opposing free ends thereof for coupling together to form a loop. The third securement strap secures to the pair of skis disposed between the toe bindings and upper tips thereof. The third securement strap includes a padded member disposed interiorly thereof. The padded member is positionable between the pair of skis in an operative orientation to preclude the pair of skis from sliding with respect to one another. A reversible carrying pouch is provided that is dimensioned for receiving the central strap member, the first, second, and third securement straps within an interior thereof in a first orientation. The carrying pouch has an open upper end with a two-way zippered closure coupled therewith. A central portion of the central strap member is secured to the interior of the carrying pouch by a securement band. The carrying pouch has an adjustable waist belt secured thereto for securing the carrying pouch around a waist of a skier. The carrying pouch reverses to a second orientation for receiving the adjustable waist belt within the interior thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ski securement and carrying harness which has all the advantages of the prior art ski carriers and none of the disadvantages.

It is another object of the present invention to provide a new and improved ski securement and carrying harness which may be easily and efficiently manufactured and marketed.

It is a further object of the present invention to provide a new and improved ski securement and carrying harness which is of durable and reliable construction.

An even further object of the present invention is to provide a new and improved ski securement and carrying harness which is susceptible of a low cost of manufacture with regard to both materials and labor, and which accordingly is then susceptible of low prices of sale to the consuming public, thereby making such a ski securement and carrying harness economically available to the buying public.

Even still another object of the present invention is to provide a new and improved ski securement and carrying harness for enabling a skier to carry their skis in a practical manner.

Lastly, it is an object of the present invention to provide a new and improved ski securement and carrying harness including an adjustable central strap member. A first securement strap is fixedly secured to an upper end of the central strap member. The first securement strap secures to a pair of skis disposed below toe bindings thereof to facilitate securement of the pair of skis together. A second securement strap is fixedly secured to a lower end of the central strap member. The second securement strap secures to the pair of skis disposed below heel bindings thereof to facilitate securement of the pair of skis together. A third securement strap is slidably coupled with the central strap member by a coupling loop intermediate the first securement strap and the adjustment bracket. The third securement strap secures to the pair of skis disposed between the toe bindings and upper tips thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of the present invention as taken along line 5—5 of FIG. 3.

FIG. 6 is an elevated front view of the present invention illustrated in a stowed orientation.

The same reference numerals refer to the same parts through the various figures.

DESCRIPTION OF THE PREFERRED EMBODIMENT

Figure 1:
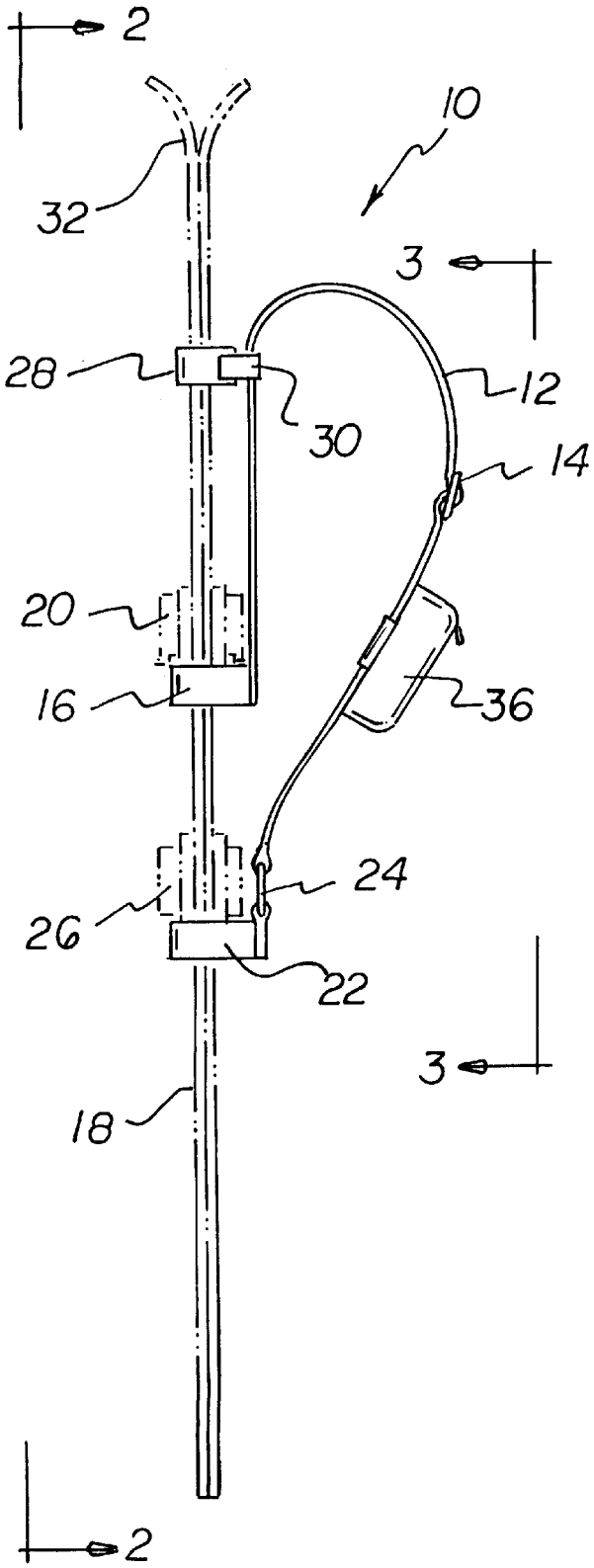
FIG. 1 is a side view of the preferred embodiment of the ski securement and carrying harness constructed in accordance with the principles of the present invention.
Figure 2:
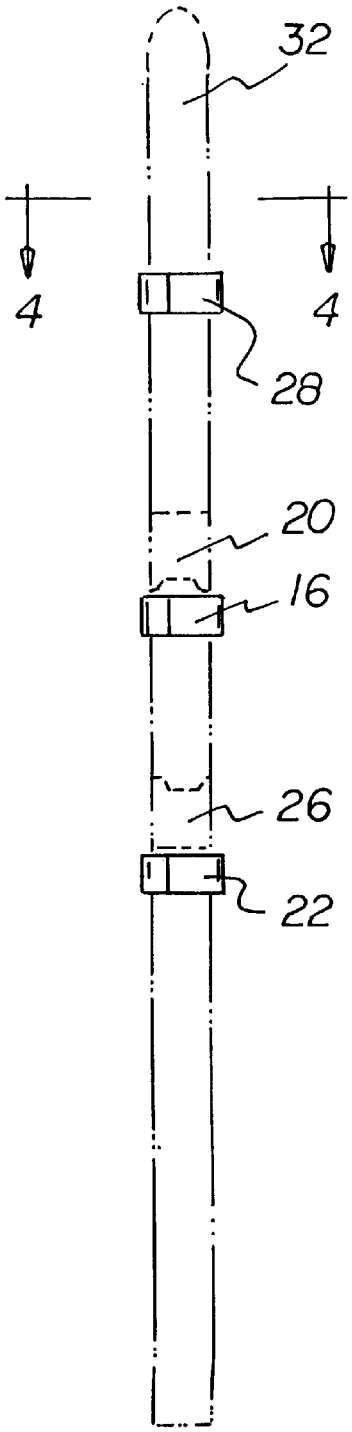
FIG. 2 is a front view of the present invention illustrated in use as taken along line 2—2 of FIG. 1.
Figure 3:
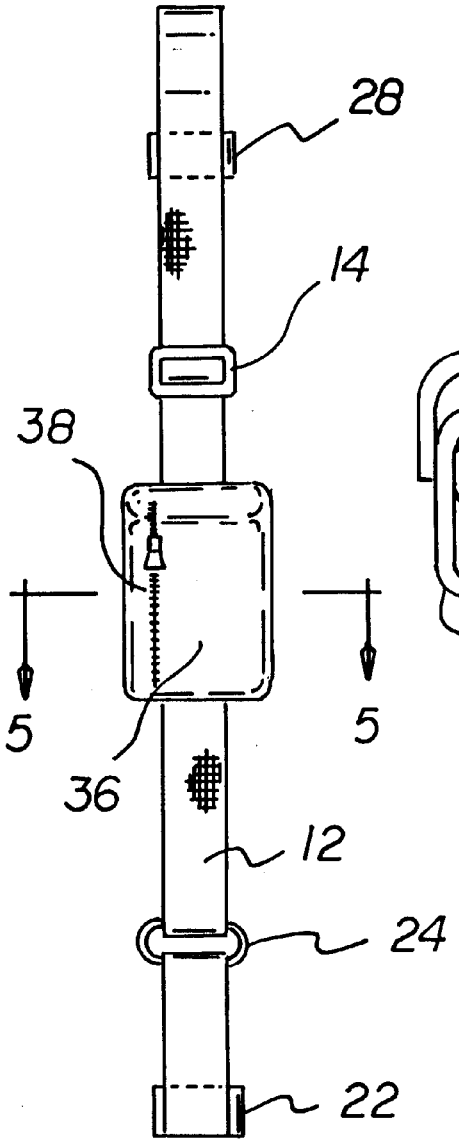
FIG. 3 is rear view of the present invention as taken along line 3—3 of FIG. 1.
Figure 4:
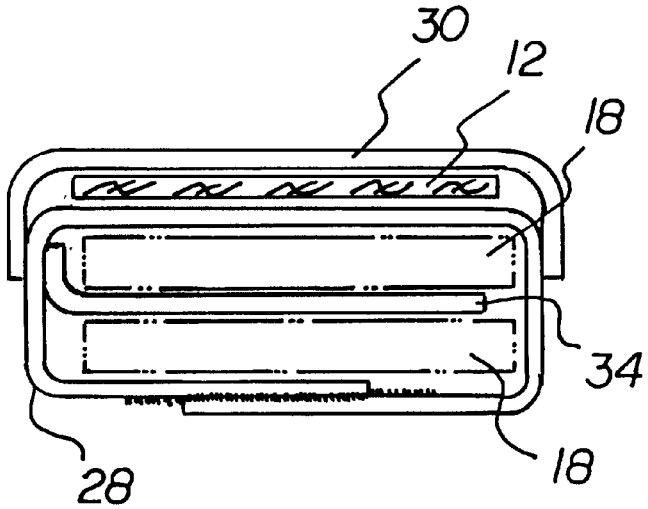
FIG. 4 is a cross-sectional view of the present invention as taken along line 4—4 of FIG. 2.

With reference now to the drawings, and in particular, to FIGS. 1 through 6 thereof, the preferred embodiment of the new and improved ski securement and carrying harness embodying the principles and concepts of the present invention and generally designated by the reference number 10 will be described.

Specifically, it will be noted in the various Figures that the device relates to a ski securement and carrying harness for enabling a skier to carry their skis in a practical manner. In its broadest context, the device consists of an adjustable central strap member, a first securement strap, a second securement strap, a third securement strap, and a reversible carrying pouch. Such components are individually configured and correlated with respect to each other so as to attain the desired objective.

The adjustable central strap member 12 has an adjustment bracket 14 disposed thereon to facilitate varying a total length thereof. The strap member 12 can be adjusted to accommodate ski's of varying lengths and user's of varying heights.

The first securement strap 16 is fixedly secured to an upper end of the central strap member 12. The first securement strap 16 has hook and loop closures disposed on opposing free ends thereof for coupling together to form a loop. Alternate forms of closure could be used in lieu of the hook and loop closures. The first securement strap 16 secures to a pair of skis 18 disposed below toe bindings 20 thereof to facilitate securement of the pair of skis 18 together.

The second securement strap 22 is fixedly secured to an O-ring 24 disposed on a lower end of the central strap member 12. The O-ring 24 provides a degree of pivotability that is required when transporting skis using the device 10. The second securement strap 22 has hook and loop closures disposed on opposing free ends thereof for coupling together to form a loop. The second securement strap 22 secures to the pair of skis 18 disposed below heel bindings 26 thereof to facilitate securement of the pair of skis 18 together.

The third securement strap 28 is slidably coupled with the central strap member 12 by a coupling loop 30 intermediate the first securement strap 16 and the adjustment bracket 14. The third securement strap 28 has hook and loop closures disposed on opposing free ends thereof for coupling together to form a loop. The third securement strap 28 secures to the pair of skis 18 disposed between the toe bindings 20 and upper tips 32 thereof. The third securement strap 28 includes a padded member 34 disposed interiorly thereof. The padded member 34 is positionable between the pair of skis 18 in an operative orientation to preclude the pair of skis 18 from sliding with respect to one another. By moving the third strap securement strap 28 closer to the second securement strap 22 will enable shorter persons to carry skis without risk of the skis dragging on a ground area. Additionally, in order to carry ski poles, the straps of the ski poles can be looped over the tips of the skis while the lower ends of the poles are engaged by the second securement strap 22.

The reversible carrying pouch 36 is dimensioned for receiving the central strap member 12, the first, second, and third securement straps 16,22,28 within an interior thereof in a first orientation. Note FIG. 6. The carrying pouch 36 has an open upper end with a two-way zippered closure 38 coupled therewith. A central portion of the central strap member 12 is secured to the interior of the carrying pouch 36 by a securement band 40. The carrying pouch 36 has an adjustable waist belt 42 secured thereto for securing the carrying pouch 36 around a waist of a skier. The carrying pouch 36 reverses to a second orientation for receiving the adjustable waist belt 42 within the interior thereof. Note FIG. 5. When the device 10 is not in use, the central strap member 12, and the securement straps 16, 22, and 28 are secured within the carrying pouch 36 and the carrying pouch can be secured to the user's body via the waist belt 42. In order to use the device to carry the pair of skis 28, or in the alternative a snowboard, the carrying pouch 36 is simply opened and the central strap member 12 and the securement straps 16,22, and 28 are removed. The carrying pouch 36 is then turned inside out and the waist belt 42 is secured therein. The securement straps are then secured to the pair of skis 28, note FIGS. 1 and 2, and the central strap member 12 is positioned over the user's shoulder in order to carry the skis 18.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A ski securement and carrying harness for enabling a skier to carry their skis in a practical manner comprising, in combination:

an adjustable central strap member having an adjustment bracket disposed thereon to facilitate varying a total length thereof;

a first securement strap fixedly secured to an upper end of the central strap member, the first securement strap having hook and loop closures disposed on opposing free ends thereof for coupling together to form a loop, the first securement strap is securable to a pair of skis disposed below toe bindings thereof to facilitate securement of the pair of skis together;

a second securement strap fixedly secured to an O-ring disposed on a lower end of the central strap member, the second securement strap having hook and loop closures disposed on opposing free ends thereof for coupling together to form a loop, the second securement strap is securable to the pair of skis disposed below heel bindings thereof to facilitate securement of the pair of skis together;

a third securement strap slidably coupled with the central strap member by a coupling loop intermediate the first securement strap and the adjustment bracket, the third securement strap having hook and loop closures disposed on opposing free ends thereof for coupling together to form a loop, the third securement strap is securable to the pair of skis disposed between the toe bindings and upper tips thereof, the third securement strap including a padded member disposed interiorly thereof, the padded member being positionable between the pair of skis in an operative orientation to preclude the pair of skis from sliding with respect to one another;

a reversible carrying pouch dimensioned for receiving the central strap member, the first, second, and third securement straps within an interior thereof in a first orientation, the carrying pouch having an open upper end with a two-way zippered closure coupled therewith, a central portion of the central strap member secured to the interior of the carrying pouch by a securement band, the carrying pouch having an adjustable waist belt secured thereto for securing the carrying pouch around a waist of a skier, the carrying pouch reversing to a second orientation for receiving the adjustable waist belt within the interior thereof.

2. A ski securement and carrying harness for enabling a skier to carry their skis in a practical manner comprising, in combination:

an adjustable central strap member;

a first securement strap fixedly secured to an upper end of the central strap member, the first securement strap is securable to a pair of skis disposed below toe bindings thereof to facilitate securement of a pair of skis together;

a second securement strap fixedly secured to a lower end of the central strap member, the second securement strap is securable to the pair of skis disposed below heel bindings thereof to facilitate securement of the pair of skis together;

a third securement strap slidably coupled with the central strap member by a coupling loop intermediate the first securement strap and the second securement strap, the third securement strap is securable to the pair of skis disposed between the toe bindings and upper tips thereof; and a reversible carrying pouch secured to the central strap member and dimensioned for receiving the central strap member, the first, second, and third securement straps within the interior thereof in a first orientation.

3. The ski securement and carrying harness as set forth in claim 2 wherein the adjustable central strap member has an adjustment bracket disposed thereon to facilitate varying a total length thereof.

4. The ski securement and carrying harness as set forth in claim 2 wherein the first securement strap has hook and loop closures disposed on opposing free ends thereof for coupling together to form a loop.

5. The ski securement and carrying harness as set forth in claim 2 wherein the second securement strap has hook and loop closures disposed on opposing free ends thereof for coupling together to form a loop.

6. The ski securement and carrying harness as set forth in claim 2 wherein the third securement strap has hook and loop closures disposed on opposing free ends thereof for coupling together to form a loop.

7. The ski securement and carrying harness as set forth in claim 2 wherein the third securement strap includes a padded member disposed interiorly thereof, the padded member being positionable between the pair of skis in an operative orientation to preclude the pair of skis from sliding with respect to one another.

8. The ski securement and carrying harness as set forth in claim 2 wherein the carrying pouch has an open upper end with a two-way zippered closure coupled therewith, a central portion of the central strap member secured to the interior of the carrying pouch by a securement band, the carrying pouch having an adjustable waist belt secured thereto for securing the carrying pouch around a waist of a skier, the carrying pouch reversing to a second orientation for receiving the adjustable waist belt within the interior thereof.

* * * * *